US005086710A

United States Patent [19]

Korb

[11] Patent Number: 5,086,710

[45] Date of Patent: Feb. 11, 1992

[54] TABLE WITH SUPPORT FRAME AND TABLETOP AND CONTROL DEVICE FOR VARYING THE HEIGHT AND INCLINATION OF THE TABLETOP

[75] Inventor: Daniel Korb, Stuttgart, Fed. Rep. of Germany

[73] Assignee: Dyes GmbH, Fed. Rep. of Germany

[21] Appl. No.: 423,148

[22] Filed: Oct. 18, 1989

[30] Foreign Application Priority Data

Oct. 19, 1988 [DE] Fed. Rep. of Germany .... 38 35 591

[51] Int. Cl.[5] ..... A47F 5/12

[52] U.S. Cl. ..... 108/4; 108/5

[58] Field of Search ..... 108/4, 5, 7, 9, 10, 108/147

[56] References Cited

U.S. PATENT DOCUMENTS 2,585,535 2/1952 Carlsson .

FOREIGN PATENT DOCUMENTS 1114290 9/1961 Fed. Rep. of Germany .
2530956 1/1977 Fed. Rep. of Germany ..... 108/147
2743073 8/1979 Fed. Rep. of Germany .
3207177 9/1983 Fed. Rep. of Germany .
3438313 4/1986 Fed. Rep. of Germany .
8610844 8/1986 Fed. Rep. of Germany .

*Primary Examiner*—Kenneth J. Dorner
*Assistant Examiner*—Gerald A. Anderson
*Attorney, Agent, or Firm*—Speckman & Pauley

[57] ABSTRACT

The invention relates to a table with a table frame and a tabletop, which is settable in both height and inclination by a control device. Varying the height and inclination of the tabletop with a simple control device and a support frame is accomplished by providing that the control device has two support devices. The two support devices are pivotally attached to the support frame in the upper region of the middle cross member of the support frame about transversely extending pivot shafts. The support devices on the underside of the tabletop are supported on the tabletop about transversely extending pivot shafts, but are guided adjustably within the depth of the tabletop. The control device selectively raises the support devices individually or in common upward in the direction of the tabletop or lowers them individually or in common downward in the direction of the support frame, in the course of which platform-shaped pivot shafts of the support devices move toward or away from one another.

27 Claims, 11 Drawing Sheets

TABLE WITH SUPPORT FRAME AND TABLETOP AND CONTROL DEVICE FOR VARYING THE HEIGHT AND INCLINATION OF THE TABLETOP

BACKGROUND OF THE INVENTION

1. Field of the Invention

The invention relates to a table with a support frame and a tabletop wherein both the height and inclination can be set with a control device.

2. Description of the Prior Art

Various tables exist that have lateral supports as a support frame and in which support guide profiles attached to the tabletop are adjustably guided in telescoping fashion, for example, as described in examined and published German Patent Application DE-AS 27 43 073. The German '073 patent discloses certain parts of a control device that are provided for varying the height of the tabletop can also be accommodated in the supports. For varying its inclination, the tabletop is additionally pivotally supported on the guide profiles, and the axis of rotation extends in the transverse direction of the tabletop. The guide profiles must be locked in each position, relative to the supports. The pivot bearings of the tabletop must be locked in each position, relative to the guide profiles. Not only is such a control device complicated, but with a heavy tabletop, the telescoping guides tend to tilt and jam between the guide profiles and the supports, unless additional means for improving the guidance are provided.

As shown in published, German Patent Application DE-OS 34 38 313, a table is also known which is connected directly to the feet via two parallelogram guides. This control device permits only limited variation in height, because if the pivot angle of the parallelogram guides is too wide, the table loses stability. The tabletop must also be attached to the parallelogram guides so that it can be both pivoted and locked, in order to vary the inclination of the tabletop, which once again complicates the control device and makes it expensive.

SUMMARY OF THE INVENTION

It is an object of the invention to devise a table of the type which needs only a simple control device, eliminates complicated telescoping guides, allows a wide range of variation in height and inclination of the tabletop, and can be adjusted selectively in the height position while leaving the inclination unchanged, or in the inclination position while leaving the height position of a transversely extending tabletop edge approximately the same.

According to one embodiment of the invention, the above object is accomplished by having a control device with two support devices. The two support devices are pivotally attached to the support frame, in the upper region of the transverse middle of the support frame, about transversely extending pivot shafts. The support devices on the underside of the tabletop are supported on the tabletop about transversely extending pivot shafts, but are adjustably guided within the depth of the tabletop. The control device selectively raises the support devices, individually or together, upward in the direction toward the tabletop or lowers them downward in the direction toward the support frame. In the course of raising or lowering, the platform-like pivot shafts of the support devices move relative to one another.

The two support devices protrude to the front and back from the upper middle region of the support frame and bear the tabletop on the ends facing one another. With the control device, both support devices can be simultaneously raised and lowered, and the height of the tabletop varies while the inclination remains unchanged. If only one support device is pivoted, then the inclination of the tabletop varies while the height of the transversely extending tabletop edge, on the support device that is not adjusted, remains approximately the same. The pivotal support devices do not present any problems of tilting or jamming. The table is stable even when the ranges of adjustment of the height and inclination are great.

In another embodiment of the invention, each support device is embodied as a pair of pivot levers spaced transversely apart. For aesthetic reasons and reasons of stability, this embodiment may also be such that each support device is embodied as a platform-like support element extending over a major part of the transverse direction.

The adjustability of the support devices on the tabletop is obtained in a simple manner. Each support device is supported on the tabletop via two joints forming the pivot shaft. The joints are disposed on slides which are guided in pairs and adjustable relative to one another within guide rails. The guide rails extend in the direction of the depth of the tabletop. Preferably the guide rails are embodied as C-profile sections, and the slides have brackets that protrude from the guide rails and are pivotally connected to the support devices. The slides are definitively guided and offer a simple option for pivotal connection of the support devices, without limiting their pivoting range.

In another embodiment of the invention, the pivotal connection of the support devices on the support frame is accomplished by the support frame having two lateral supports resting on two feet. The two lateral supports are connected to one another in the vicinity of the upper transverse middle, with a skirt. The support devices are pivotally connected near the front and rear end of the skirt.

To assure that the tabletop assumes a defined position with respect to the control devices in the direction of the depth of the tabletop, a further embodiment of the invention has at least one guide arm which is pivotally connected to the underside of the tabletop and is supported pivotally on the support frame near the rear end of the skirt. The same effect can also be accomplished by having a spur wheel rotatably supported at least near a guide rail between the two slides, with the axis of rotation extending in the transverse direction of the tabletop. The spur wheel meshes diametrically with two racks which extend longitudinally with respect to the guide rail and are firmly connected to the slides which are adjustable in the guide rail.

In another embodiment of the invention, the pivoting motions can be transferred to the support devices in such a way that two threaded spindles extending in the longitudinal direction of the guide rails are used as the control device, and are adjustable, but undisplaceable and freely rotatable, on the underside of the tabletop in threaded bores of the slides. The threaded spindles assigned to the control devices can be driven either individually by each control device or together, depending on whether the inclination of the height of the tabletop is variable. For adjustment, as the control device for the two slides that are adjustable within a guide rail, a common threaded spindle having two opposing threaded segments is used, which are fixed adjustably, but undisplaceable and freely rotatable, on the underside of the tabletop in correspondingly opposed threaded bores of the slides.

Selectability in varying the height or inclination is additionally provided by joining the two threaded segments of the threaded spindle together with a coupling and assigning a drive mechanism to only the threaded segment oriented toward the front end of the tabletop. The height of the tabletop is variable with the coupling engaged, and its inclination is variable with the coupling disengaged, both with the single drive mechanism.

In another embodiment of the invention, a simple control device having each support device is guided with a respective extension into the two supports of the support frame. Each extension is coupled to a catch, which is adjustable on a horizontal threaded shaft that is rotatably supported in the support. Each threaded shaft has a drive disk secured against relative rotation. The drive disks assigned to one support device can each be set into rotational motion with an endless, or continuous, bead chain drivable to rotate in both directions. At least one endless bead chain, preferably the one assigned to the front support device, is individually driven, and both endless bead chains can be driven together.

Driving the two endless bead chains together to vary the height of the tabletop is accomplished by the threaded shafts assigned to the two support devices having opposed thread directions, and by the two endless bead chains revolving in the same direction when driven. Then both drive coupling disks need to be coupled only to the drive means. This is accomplished by guiding each endless bead chain via one drive coupling disk disposed on the underside of the tabletop. The two drive coupling disks are disposed one directly behind the other, with a common axis of rotation; and the drive mechanism can be a manual crank or a drive motor which is coupled selectively to one or both drive sockets of the drive coupling disks. In order to obtain a defined revolution of the endless bead chains between the drive coupling disks and the drive disks on the threaded shafts, hoses or tubes may be attached in the support frame.

BRIEF DESCRIPTION OF THE DRAWINGS

The invention will be described in further detail with reference to exemplary embodiments shown in the drawings wherein.

DESCRIPTION OF THE PREFERRED EMBODIMENTS

Figure 1:
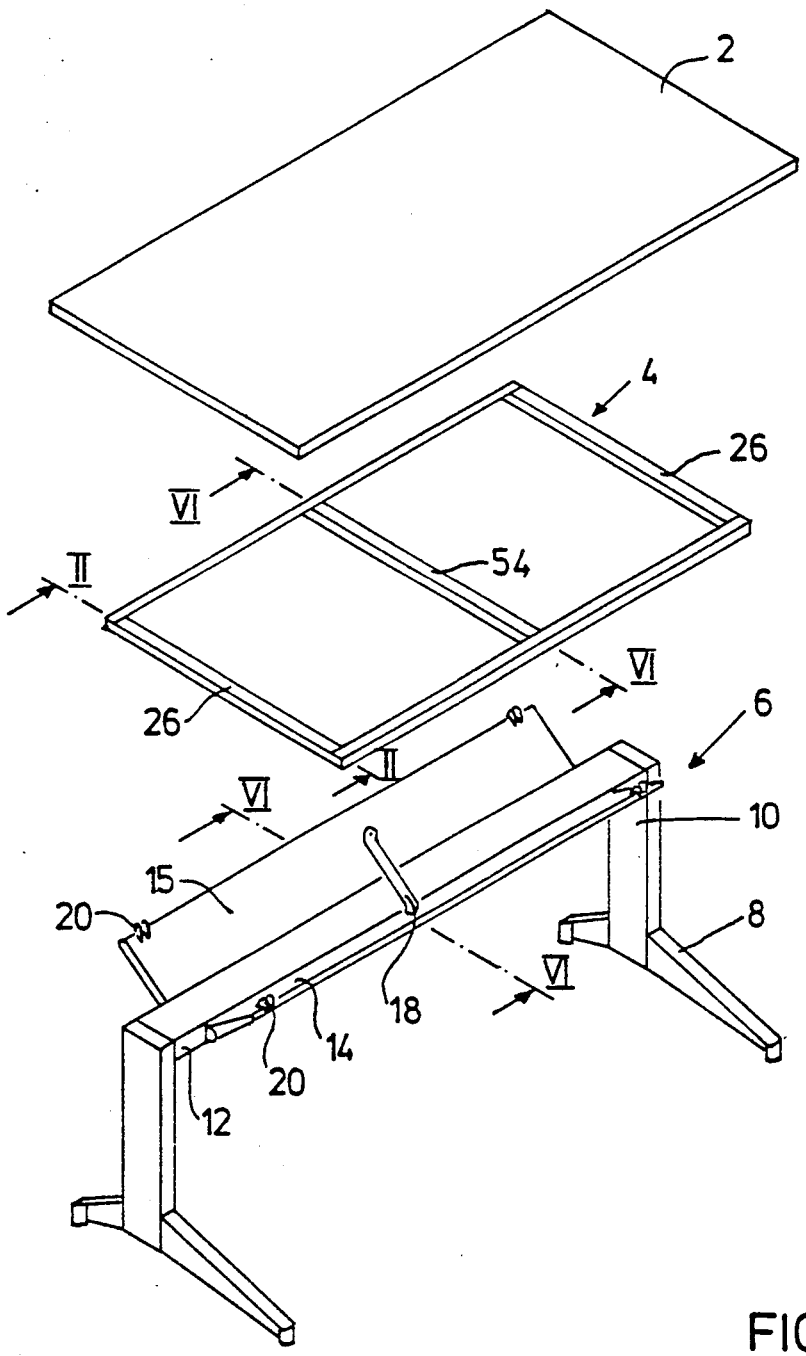
FIG. 1 is an exploded perspective view of one embodiment of a table according to the invention.

FIG. 1 shows one embodiment of the invention having tabletop 2. Beneath tabletop 2 is table frame 4, which is constructed of hollow pieces of a light metal. Beneath table frame 4, support frame 6 has feet 8, the front parts of which are longer than the back parts. Feet 8 are connected to two supports 10. Skirt 12 is fastened between two supports 10 and connecting them with each other. Skirt 12 is in the form of a hollow box element and, in cross section has a U-shape, for example, which is open at the top. Two support devices 14 and 15 which are in the form of support plates are pivotally attached with respect to skirt 12. The table has a front support device 14 and a rear support device 15. Support devices 14 and 15 are in the form of hollow pieces made of sheet metal and may be reinforced by laterally extending beads. Both control devices 14 and 15 are fastened on skirt 12 and pivot about shafts 16 and 17 which extend in a longitudinal direction of skirt 12, for example, in a cross direction to the tabletop. At the back end of skirt 12, arm 18 is also pivotally fastened on shaft 17, extending in a longitudinal direction of skirt 12.

Figure 3:
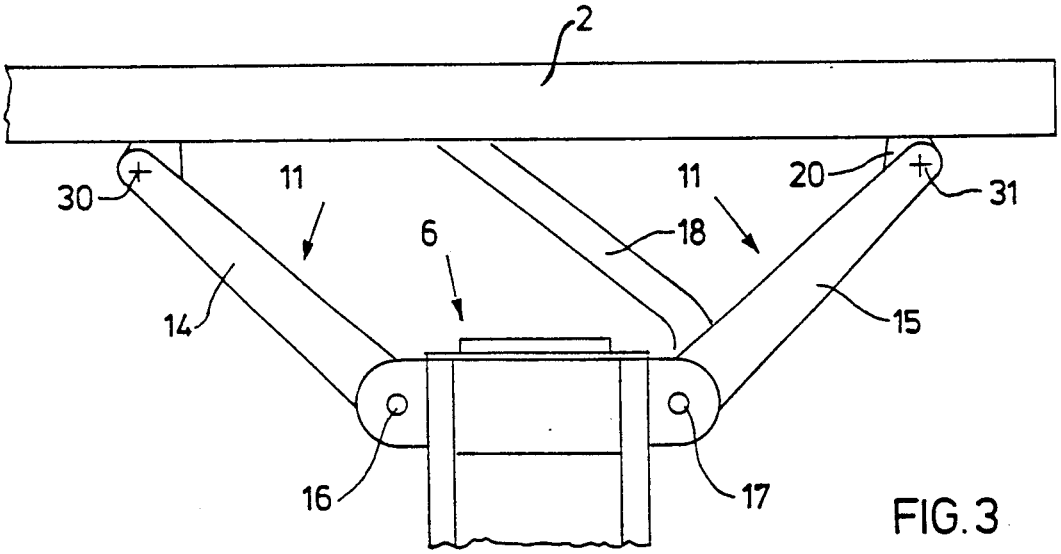
FIG. 3 is a side view showing the table with the control devices pivoted upward.
Figure 4:
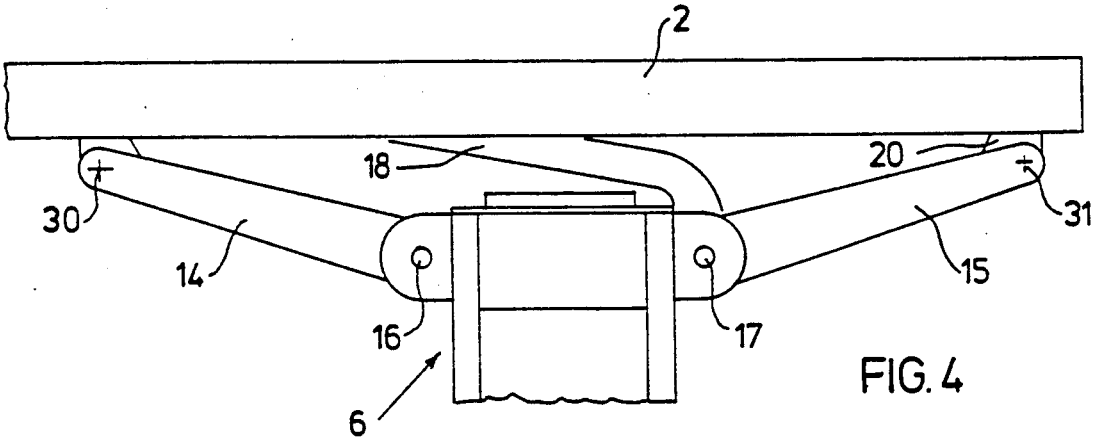
FIG. 4 is a side view showing the table with the control devices pivoted downward.
Figure 5:
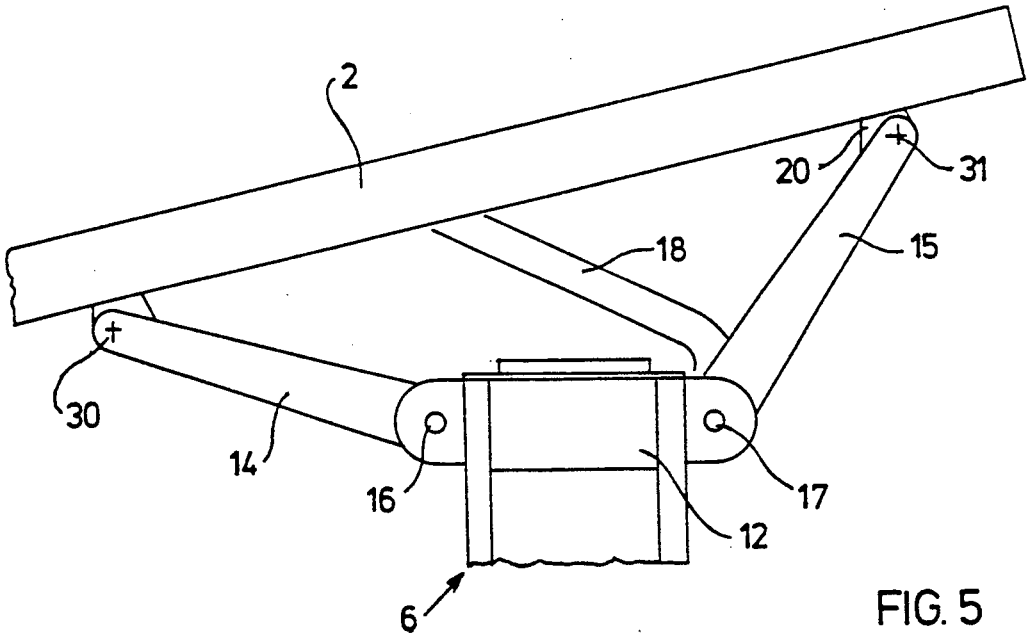
FIG. 5 is a side view showing the table with the tabletop inclined.

FIGS. 3 to 5 show how tabletop 2 can be adjusted. If two support devices 14 and 15 are pivoted upward together, tabletop 2 is raised. If two control devices 14 and 15 are pivoted downward together, tabletop 2 is lowered. If rear control device 15 remains up, while front control device 14 is lowered, tabletop 2 has a front inclination which is determined by the pivot angle of front support device 14.

Figure 2A:
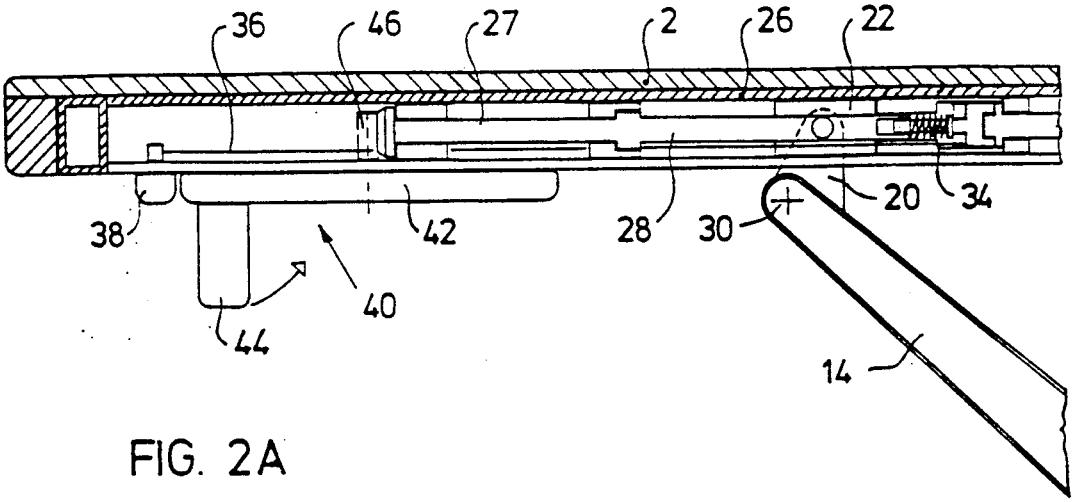
FIGS. 2A and 2B each show a vertical section through the table taken in the plane II—II of FIG. 1.
Figure 2B:
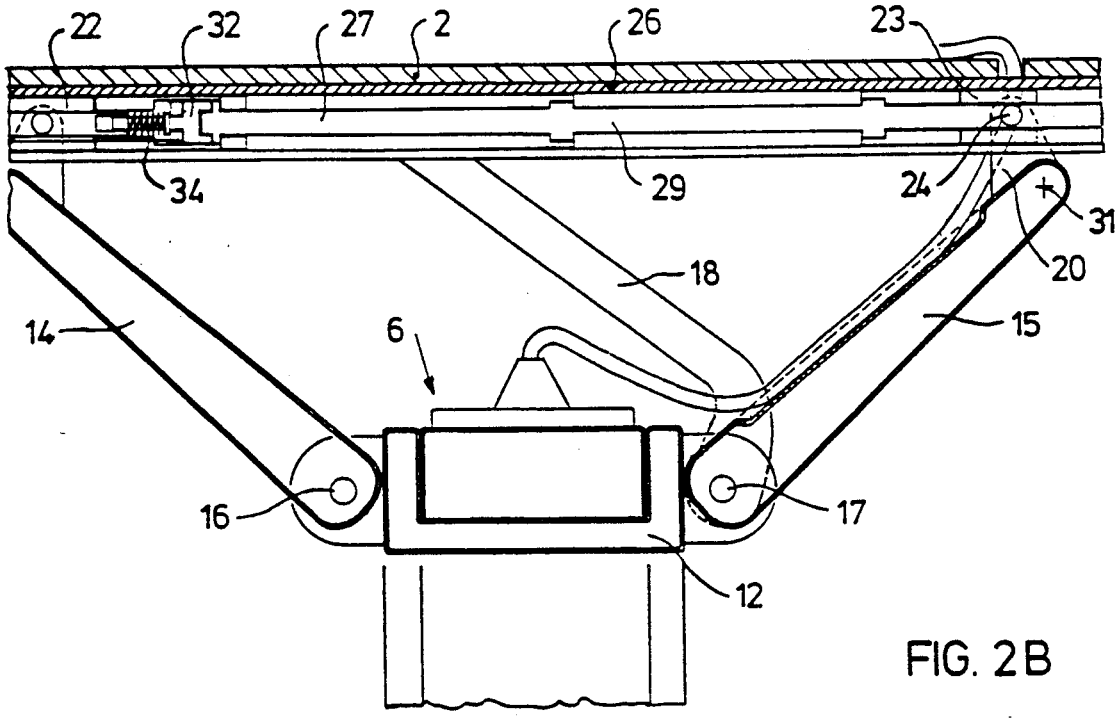
Figure 7:
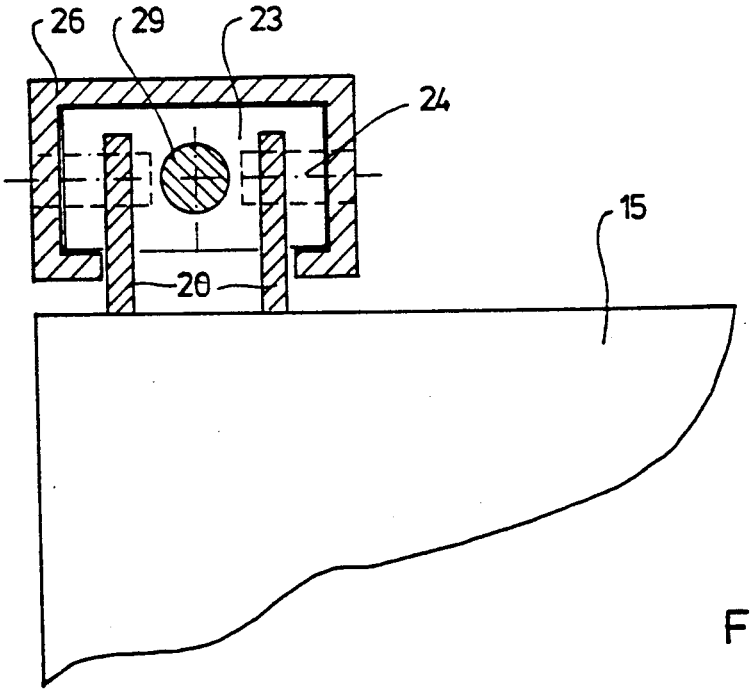
FIG. 7 is a cross-sectional view through part of the table frame and includes a partial view of the upper left corner of the rear control device and shows an attachment to one segment of a threaded spindle.

Details for the adjustment of support devices 14 and 15 can be seen from FIGS. 2A, 2B and 7, which can be combined to make a single drawing figure. Each support device 14 and 15, on its edge facing away from skirt 12 near their external right and left ends, has two brackets 20 rigidly secured to support devices 14 and 15.

Referring to FIGS. 2A, 2B and 7, the outer ends of brackets 20 each pivot about shafts 24 on a slide 22 or 23 having inner threads. Front glide 22 and rear glide 23 are slidingly guided in pieces having a C-shape, open at the bottom, in the form of guide rails 26 of table frame 4. In guide rails 26, in the form of C-shaped pieces, two segments 28 and 29 of a threaded spindle 27 are rotatably and nonslidingly mounted. Segments 28 and 29 have oppositely wound threads, for example, the front segment a right-handed thread and the rear segment a left-handed thread. The associated front and rear slides 22 and 23 have corresponding inner threads. A coupling 32 is located between the two segments 28 and 29 of the threaded spindles. If it is engaged, it connects the two segments 28 and 29 of the threaded spindle 27. However, if it is disengaged, the rotatable connection between the two segments 28 and 29 is severed. Coupling 32 is maintained in the engaged state by compression spring 34. Compression spring 34 can be disengaged through pull element 36, for example a wire, or with hand pull 38. After letting go of hand pull 38, spring 34 again returns into the position illustrated in which both segments 28, 29 are connected with each other. Hand crank 40, comprising turntable 42 and foldable handle 44, are used to drive front segment 28 of threaded spindle 27. Hand crank 40 is in driving connection with front segment 28 of threaded spindle 27, through angle drive 46.

If, with coupling 32 engaged, front segment 28 of threaded spindle 27 is turned with hand crank 40, rear segment 29 of threaded spindle 27 is also simultaneously turned in the same direction. Because both segments 28 and 29 have oppositely turning threads, in one direction of rotation of hand crank 40 slide 22, for example, is moved forward or to the left in FIG. 2A, but slide 23 is moved backward. As a result, support devices 14, 15 and tabletop 2 are lowered. When hand crank 40 is turned in the opposite direction, support devices 14 and 15 and tabletop 2 are accordingly raised.

If, for example, in the position according to FIGS. 2A, 2B and 3, the front part of tabletop 2 is lowered so that it has an inclination as shown in FIG. 5, coupling 32 is disengaged by means of hand pull 38. If hand crank 40 is then operated, it has an effect on only front segment 28 of threaded spindle 27. If an appropriate direction of rotation is selected, slide 22 is moved forward, because front support device 14 is pivoted downward until it reaches the position as shown in FIG. 5.

Placement of threaded spindle 27 in the center of the table would be possible in principle, so that a single hand crank 40 would suffice to operate it. The wider the tables, the greater is the danger of tilting. In this case it is more practical to dispose one of the described threaded spindles 27 on the right and one on the left, as in the embodiment shown. However, then it is also necessary to operate two hand cranks 40, one to the right front and one on the left front on the underside of table frame 4.

If, in lieu of coupling 32 there is a drive for rear segments 29 of threaded spindle 27 from the rear of the table, corresponding hand cranks 40 must be disposed on the back of table frame 4. Of course threaded spindles 27 can also be coupled in such a way that they can be rotated from a single drive, for example, a single hand crank 40.

In every embodiment it is also possible to provide, instead of hand cranks 40, electric motors, in particular tube motors, which can be driven in opposite rotational directions.

Figure 6:
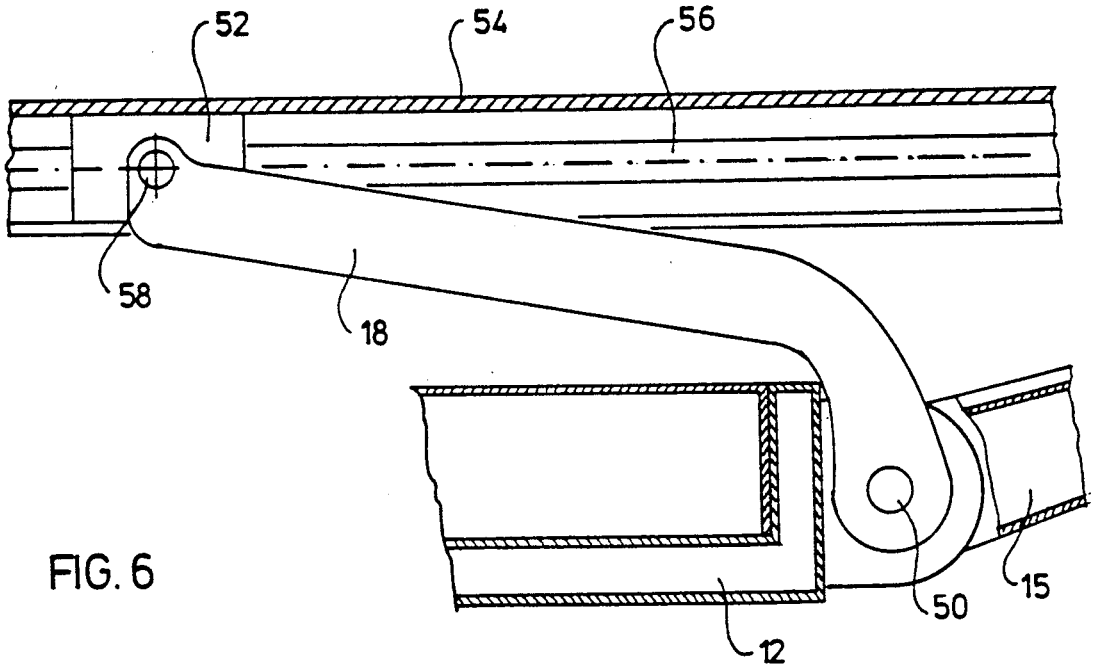
FIG. 6 is a cross-sectional view taken along the line VI—VI of FIG. 1, approximately through the middle of the table.

In the embodiment shown in FIG. 2B, arm 18 is located in approximately the center of the table, looking from left to right of FIG. 2B, and is initially used to secure tabletop 2 against displacement from the front towards the back. Because described slides 22 and 23 are freely slideable within guide rails 26 of table frame 4, the entire table frame 4 and thus tabletop 2 are freely displaceable from front to back, regardless of the setting of tabletop 2 with respect to height and inclination. Referring to FIG. 6, arm 18 is supported at the back side of skirt 12 and is free to pivot about shaft 50. Referring to FIG. 6, the upper end of arm 18 is pivotally connected with slide 52. Slide 52 is positioned freely displaceable in a C-shaped element 54. Referring to FIG. 1, C-shaped element 54 forms the center of table frame 4. Referring to FIG. 6, an additional threaded spindle 56 is rotatably positioned in C-shaped element 54. In contrast to the previously described threaded spindles 27, threaded spindle 56 has only one thread. It also can be operated by a hand crank or a motor. If threaded spindle 56 is operated, it displaces C-shaped element 54 to the front or the back with respect to slide 52, which remains in its position, so that tabletop 2 is displaced accordingly. Additionally, in FIG. 6, arm 18 is pivotally supported on both ends, as shown by axes 50 and 58. For this reason, arm 18 follows all upward and downward movements of tabletop 2 and assures by its respective position that tabletop 2 is not displaced toward the front or back by itself, in particular when a set inclination is used.

As shown in FIGS. 1–6, it is possible to have only a single arm 18 with an additional threaded spindle 56 in the center, between the two threaded spindles 27, which affect the inclination of support devices 14 and 15. However, it is also possible to provide two arms 18 on the outside and a single threaded spindle 27 in the center of the table. More than three threaded spindles 27 may be required with very wide tables.

The U-shaped skirt 12 and the space above skirt 12 as well as between control devices 14 and 15 and table frame 4 may be used for housing cables and accessories.

Figure 8:
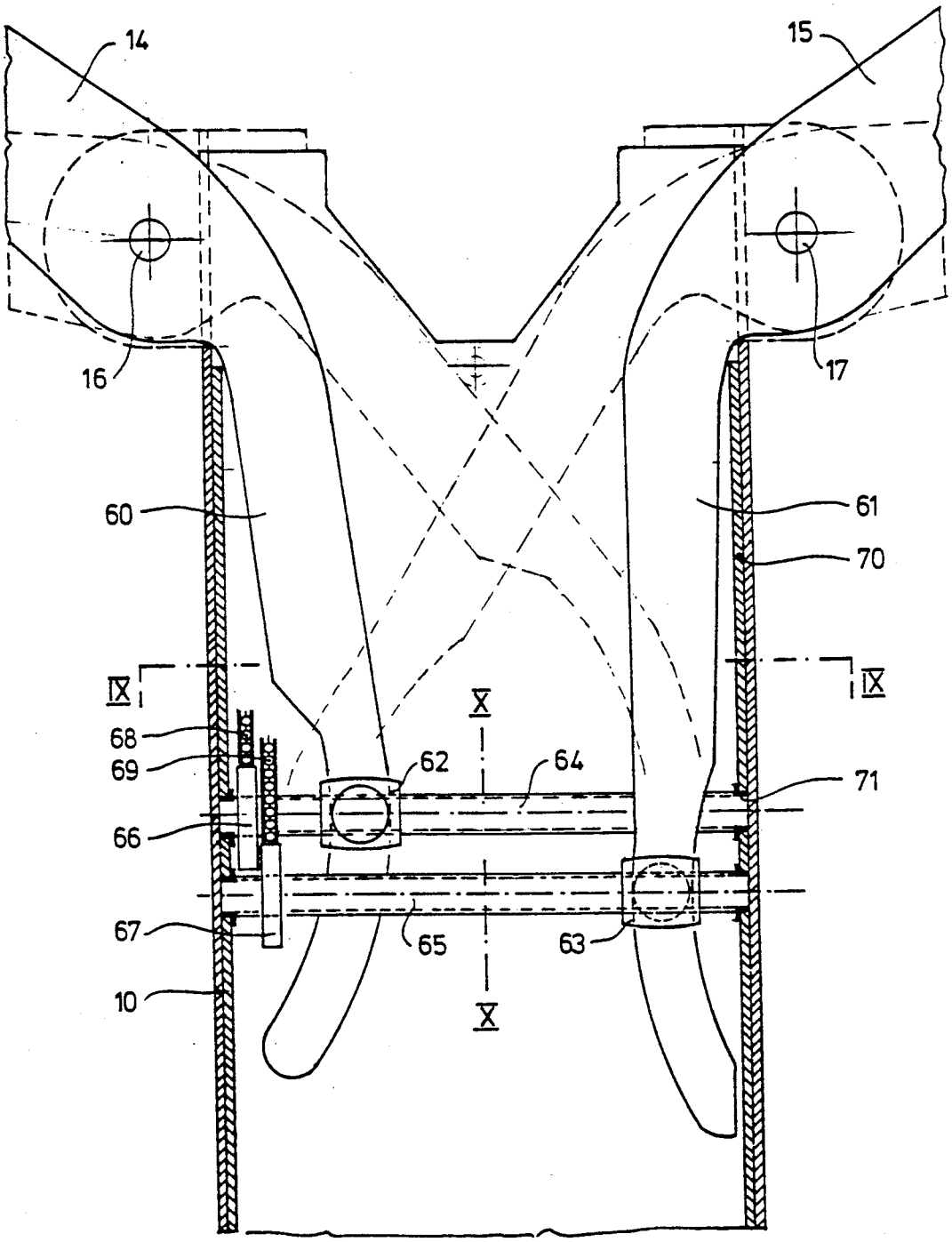
FIG. 8 is a partial cross-sectional view through one support of the support frame with a control device for the support devices.
Figure 9:
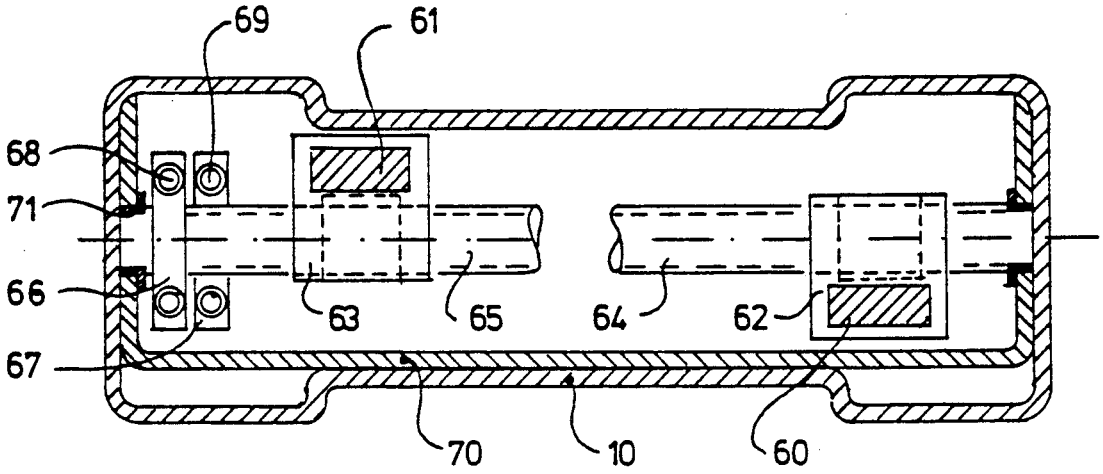
FIG. 9 is a cross-sectional view taken through the support along the line IX—IX of FIG. 8.
Figure 10:
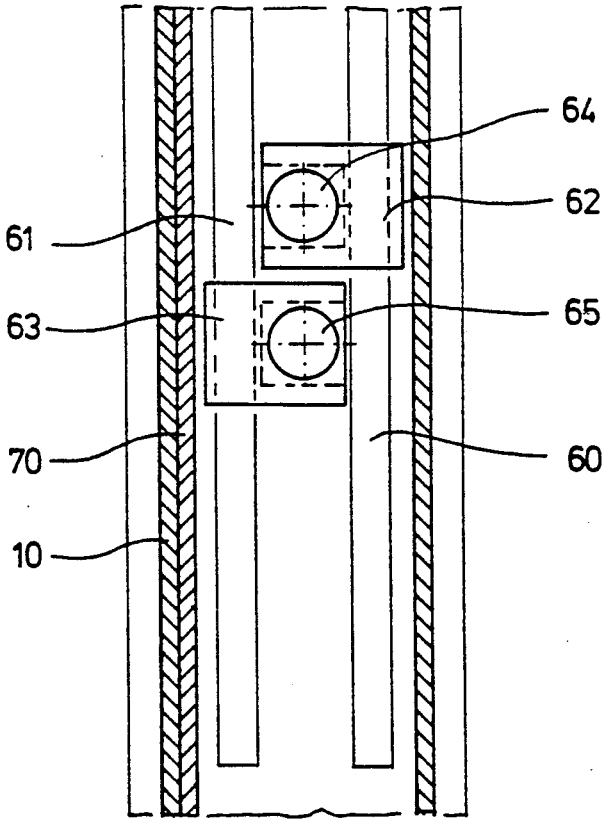
FIG. 10 is a partial cross-sectional view through the support along the line X—X of FIG. 8.
Figure 11:
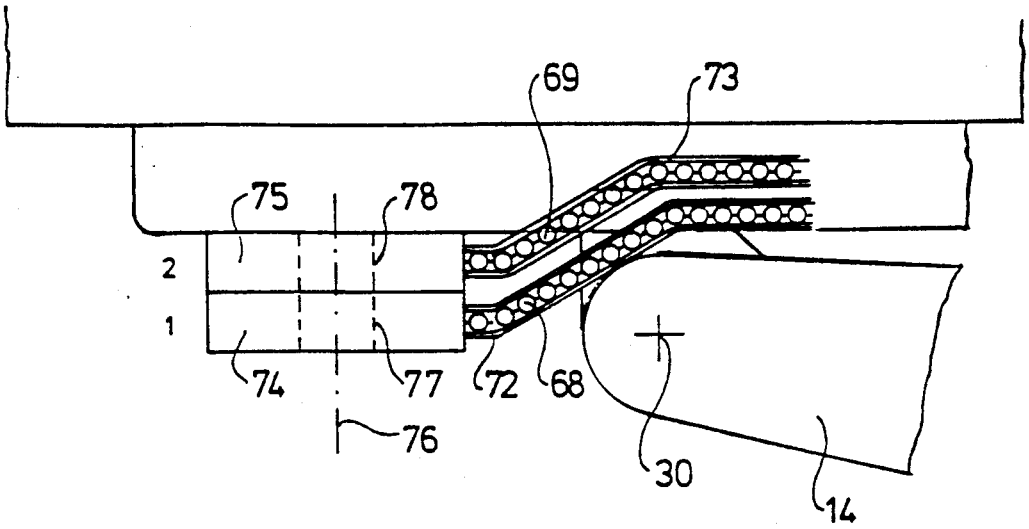
FIGS. 11 and 12 show a side view of one embodiment of the drive means the control device.

FIG. 8 shows another embodiment for a control device. Referring to FIG. 8, only the part of the control device provided per support 10 is shown. Support devices 14 and 15, pivotally supported on the front and back of skirt 12 as shown by pivot shafts 16 and 17, are brought into support 10 with extensions 60 and 61. Extensions 60 and 61 are inserted in receptacles of catches 62 and 63, which are adjustable on threaded shafts 64 and 65. Threaded shafts 64 and 65 are, as shown by the bearings 71, rotatably supported in an additional piece 70, which is inserted in support 10. Thus, the bearings of threaded shafts 64 and 65 are not visible on the exterior of support 10. In the position shown of catches 62 and 63 and extensions 60 and 61 of support devices 14 and 15, support devices 14 and 15 assume the upwardly pivoted end position and thus tabletop 2 assumes the highest position. If catches 62 and 63 are moved toward each other, support devices 14 and 15 and thus tabletop 2 are lowered. Each threaded shaft 64 or 65 has a drive disk 66 or 67 fixed against rotation, over which an endless bead chain 68 or 69 is guided as a driving means. The drive of threaded shaft 64 and 65 can be variable. If, with common adjustment of support devices 14 and 15, endless bead chains 68 and 69 rotate in the same direction, then the two threaded shafts 64 and 65 also move in the same direction of rotation. However, then threaded shafts 64 and 65, as well as the threads in catches 62 and 63, must have opposite thread directions in order to obtain the opposed motion of catches 62 and 63. If threaded shafts 64 and 65, with catches 62 and 63, are oriented the same way, endless bead chains 68 and 69 must rotate in opposite directions for a simultaneous adjustment of both support devices 14 and 15. In addition, a provision must also be made to drive at least one of the endless bead chains 68 and 69 by itself. This can be achieved, for example, in that each endless bead chain 68 or 69 is assigned a drive coupling disk 74 or 75, having drive receivers 77 and 78 oriented toward a common shaft 76. The drive, a hand crank, a drive shaft of a drive motor, or the like, is then selectively inserted only in drive receiver 77 or in both drive receiver 77 and 78, as shown in FIG. 11. In this embodiment, endless bead chain 68 alone can be driven, or both endless bead chains 68 and 69 are driven in the same direction. For this reason, the threads of threaded shafts 64 and 65 must be selected as opposing threads. If only endless bead chain 68 is driven, only the inclination of tabletop 2 changes because of lifting or lowering tabletop 2 in the front area, since only support device 14 is being adjusted. However, if both endless bead chains 68 and 69 are driven, the position of both support devices 14 and 15 is changed to the same extent. But this also means that the height of tabletop 2 is changed, while the preset inclination remains the same.

Figure 12:
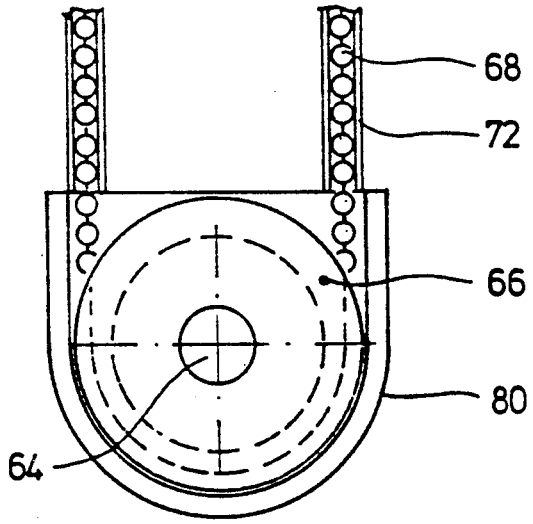

Referring to FIGS. 11 and 12, endless bead chains 68 and 69 are guided in hoses or tubes 72 and 73 between drive coupling disks 74 and 75 and drive disks 64 and 65. In the area of drive disks 64 and 65 and drive coupling disks 74 and 75, endless bead chains 68 and 69 are guided in cages 80 and comprise the driving connection.

Figure 13:
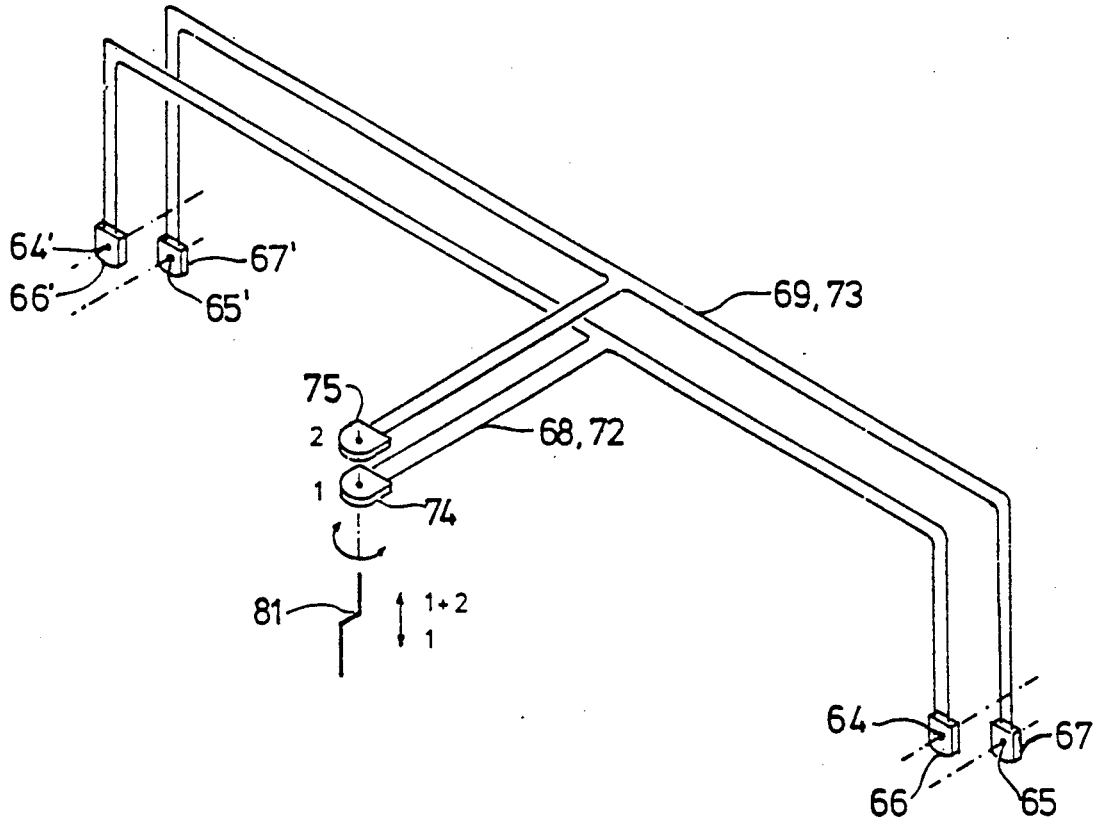
FIG. 13 is a diagrammatic view of the drive of two control devices of FIG. 8, effected with the aid of a drive mechanism as shown in FIGS. 11 and 12.

FIG. 13 illustrates how control devices can be drawn into the endless bead chain drive in both supports 10 of the table support frame. Endless bead chain 68 in hose or tube 72 is led over drive coupling disk 74 and drive disks 66 and 66', assigned to threaded shafts 64 and 64' in the same direction of rotation, so that threaded shafts 64 and 64', which are assigned to support device 14, rotate in the same direction. Endless bead chain 68 in hose or tube 73 is led over drive coupling disk 75 and drive disks 66 and 66', assigned to threaded shafts 65 and 65' in the same direction of rotation, so that threaded shafts 65 and 65', which are assigned to support device 15, rotate in the same way and also in the same way as threaded shafts 64 and 64'. In the course of common drive of endless bead chains 68 and 69 both support devices 14 and 15 are therefore raised or lowered, depending on the direction of rotation of endless bead chains 68 and 69. However, during operation in accordance with FIG. 13, threaded shafts 64 and 64' and their catches must have a thread direction opposite to that of threaded shafts 65 and 65' and their catches, in order to obtain the oppositely directed movement of the catches and support devices.

Figure 14:
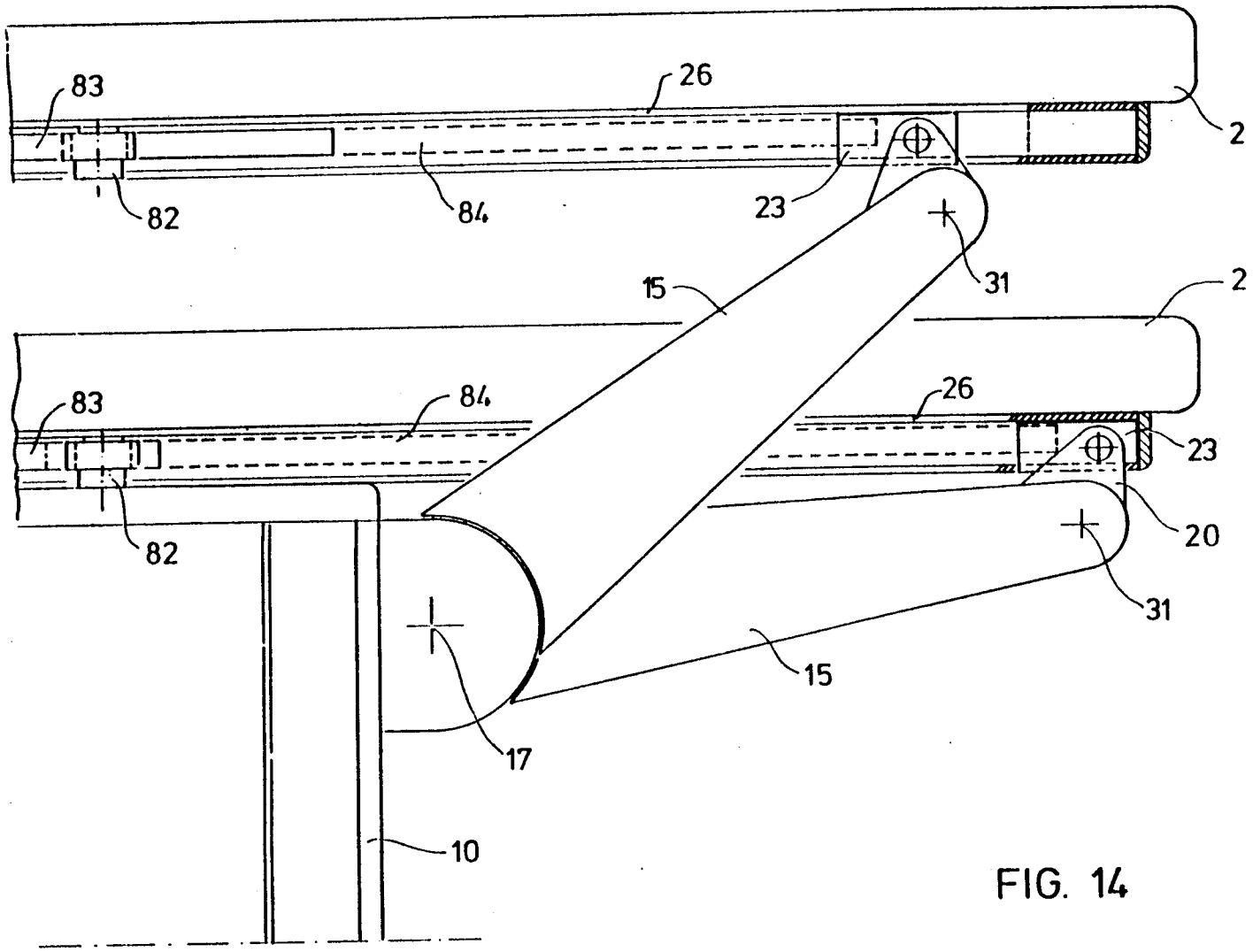
FIG. 14 shows another embodiment for the fixation of the tabletop in the direction of the depth of the tabletop upon an adjustment of the control devices.
Figure 15:
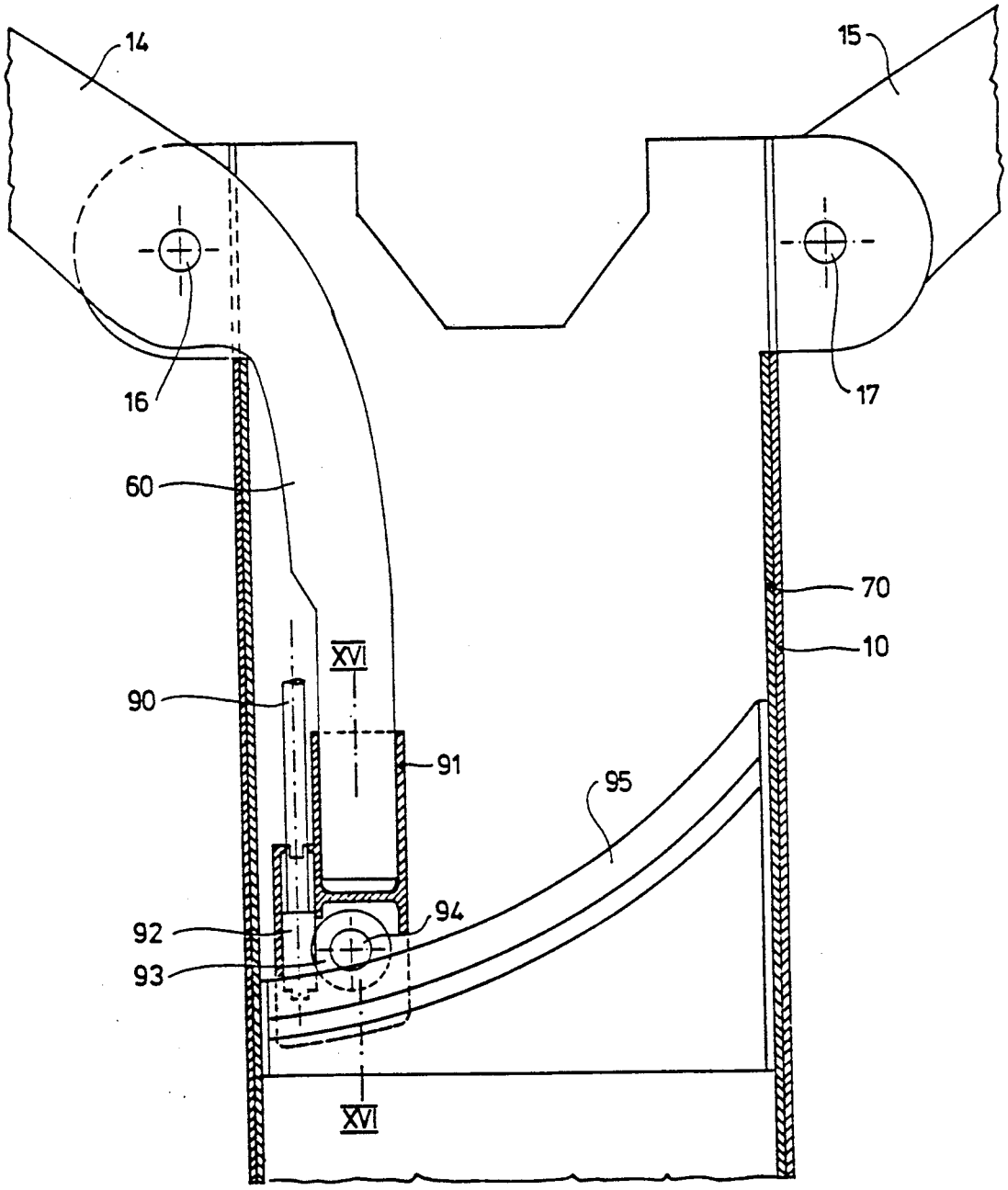
FIG. 15 is a cross-sectional view through a support having another embodiment of a control device.
Figure 16:
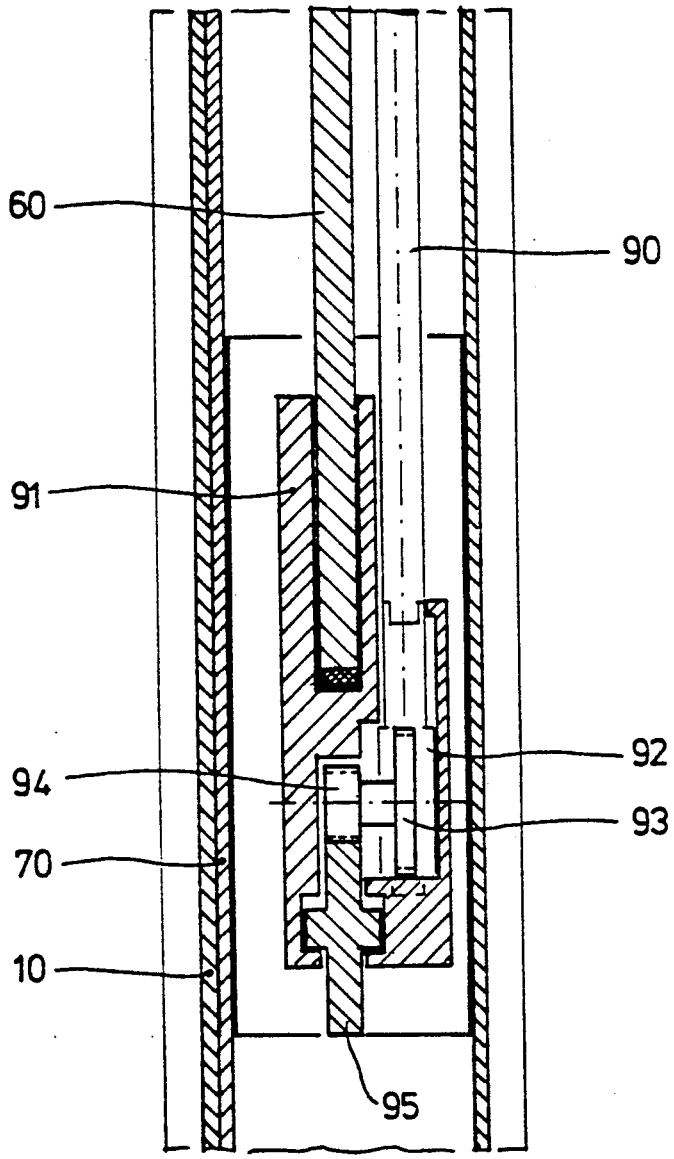
FIG. 16 is a partial cross-sectional view taken along the line XVI—XVI of FIG. 15.

As shown in FIG. 14, the position of tabletop 2 can also be fixed with respect to the base of tabletop 2 by means of a spur wheel 82 and two racks 83 and 84. Spur wheel 82 is rotatably supported in guide rail 26 between slides 22 and 23. The axis of rotation extends in a cross direction with respect to tabletop 2. The two racks 83 and 84 are diametrically disposed on spur wheel 82 and act with spur wheel 82. The ends of racks 83 and 84 oriented away from spur wheel 82 are secured with slides 22 and 23, so that they are synchronously adjusted with them. This assures that tabletop 2 is not displaced in the direction of the base of tabletop 2, even when the height is changed.

This forced fixed position of tabletop 2 preferably takes place in each one of two guide rails 26, so as to make it possible to adjust even large and heavy tabletops 2 in height and inclination, without tilting.

I claim:

1. A table having a table frame (4), a tabletop (2) and a control device (11) for adjusting height and inclination of the table, the control device (11) comprising:

two support devices (14, 15) pivotally attached to an upper region of a transverse middle of a support frame (6) about transversely extending frame pivot shafts (16, 17);

at least one guide arm (18) pivotally connected to an underside of the tabletop (2) and pivotally supported on the support frame (6) near a rear end of a skirt (12);

the support devices (14, 15) on the underside of the tabletop (2) supported on the tabletop (2) about transversely extending tabletop pivot shafts (30, 31), and the support devices (14, 15) are guided adjustably by means in a depth of the tabletop (2); and the control device (11) selectively raises at least one of the support devices (14, 15) in an upward direction toward the tabletop (2), the control device (11) selectively lowers at least one of the support devices (14, 15) in a downward direction toward the support frame (6), and the tabletop pivot shafts (30, 31) of the support devices (14, 15) are movable relative to one another.

2. The table according to claim 1 wherein each of the support devices (14, 15) comprise a pair of transversely spaced pivot levers.

3. The table according to claim 1 wherein each of the support devices (14, 15) comprise a platform-shaped support cheek extending over a part of a transverse direction.

4. The table according to claim 3 wherein the support devices (14, 15) are supported on the tabletop (2) through two joints forming the pivot shaft (30), the joints are disposed on slides (22, 23), the slides are guided in pairs and adjustable relative to one another in guide rails (26), and the guide rails (26) extend in a depth direction of the tabletop (2).

5. The table according to claim 1 wherein the support devices (14, 15) are supported on the tabletop (2) through two joints forming the pivot shaft (30), the joints are disposed on slides (22, 23), the slides are guided in pairs and adjustable relative to one another in guide rails (26), and the guide rails (26) extend in a depth direction of the tabletop (2).

6. The table according to claim 5 wherein the guide rails (26) have C-profile sections, and the slides (22, 23) have brackets (20) which protrude from the guide rails (26) and are pivotally connected to the support devices (14, 15).

7. The table according to claim 6 wherein the support frame (6) further comprises two lateral supports (10) resting on two feet (8), the lateral supports (10) are connected to one another in approximately an upper transverse middle of the skirt (12), and the support devices (14, 15) are pivotally connected near a front end and a rear end of the skirt (12).

8. The table according to claim 1 wherein the support frame (6) further comprises two lateral supports (10) resting on two feet (8), the lateral supports (10) are connected to one another in approximately an upper transverse middle of the skirt (12), and the support devices (14, 15) are pivotally connected near the front end and a rear end of the skirt (12).

9. The table according to claim 8 wherein a spur wheel (82) is rotatably supported at least near a guide rail (26) which is positioned between two slides (22, 23), the spur wheel (82) has an axis of rotation extending in a transverse direction of the tabletop (2); and the spur wheel (82) meshes diametrically with two racks (83, 84), the racks (83, 84) extend longitudinally on the guide rail (26), the racks (83, 84) are secured to the two slides (22, 23), and the two slides (22, 23) are adjustable within the guide rail (26).

10. The table according to claim 1 wherein a spur wheel (82) is rotatably supported at least near a guide rail (26) which is positioned between two slides (22, 23), the spur wheel (82) has an axis of rotation extending in a transverse direction of the tabletop (2); and the spur wheel (82) meshes diametrically with two racks (83, 84), the racks (83, 84) extend longitudinally on the guide rail (26), the racks (83, 84) are secured to the two slides (22, 23), and the two slides (22, 23) are adjustable within the guide rail (26).

11. The table according to claim 10 wherein two threaded spindles (27) extend in a longitudinal direction of guide rails (26), the guide rails (26) are adjustably fixed and the guide rails are undisplaceable and freely rotatable on an underside of the tabletop (2) within slides (22, 23) having threaded bores.

12. The table according to claim 10 wherein two slides (22, 23) are adjustable within the guide rail (26), a common threaded spindle (27) has two opposing threaded segments (28, 29), the threaded segments (28, 29) are adjustably fixed and the threaded segments (28, 29) are undisplaceable and freely rotatable on the underside of the tabletop (2) in correspondingly opposed threaded bores of the slides (22, 23).

13. The table according to claim 10 wherein the support devices (14, 15) are each guided by respective extensions (60, 61) into the two lateral supports (10) of the support frame (6);

each of the extensions (60, 61) are coupled to catches (62, 63), the catches (62, 63) are adjustable on horizontal threaded shafts (64, 65), the horizontal threaded shafts (64, 65) are rotatably supported in the lateral supports (10);

each of the threaded shafts (64, 65) have a drive disk (66, 67) attached in a manner fixed against relative rotation;

each of the drive disks (66, 67) are connected to one of the support devices (14, 15) each of the drive disks (66, 67) rotate by endless chains (68, 69); and each of the endless chains (68, 69) moves each of the support devices (14, 15), and each of the endless chains (68, 69) is moveable while the other is at rest.

14. The table according to claim 1 wherein two threaded spindles (27) extend in a longitudinal direction of guide rails (26), the guide rails (26) are adjustably fixed and the guide rails (26) are undisplaceable and freely rotatable on the underside of the tabletop (2) within slides (22, 23) having threaded bores.

15. The table according to claim 1 wherein two slides (22, 23) are adjustable within guide rails (26), a common threaded spindle (27) has two opposing threaded segments (28, 29), the threaded segments (28, 29) are adjustably fixed undisplaceable and freely rotatable on the underside of the tabletop (2) in correspondingly opposed threaded bores of the slides (22, 23).

16. The table according to claim 1 wherein the support devices (14, 15) are each guided by a respective extension (60, 61) into two supports (10) of the support frame (6); and a free end of each of the support devices (14, 15) has a rotatably supported gear wheel (94), the rotatably supported gear wheel (94) self-lockingly meshes with a circular-shaped rack (95), the gear wheel (94) and the rack (95) are aligned with the extending pivot shafts (16, 17) of the support devices (14, 15), and the gear wheel (94) and the rack (95) are secured to the supports (10) of the support frame (6).

17. The table according to claim 16 wherein the gear wheel (94) is connected and fixed against relative rotation with a drive disk, the disk drive meshes with at least one of the endless chains (68, 69) and a worm wheel (93), at least one of the endless chains (68, 69) and the worm wheel (93) mesh with a worm shaft (92), and the worm shaft (92) is driven by a flexible shaft (90).

18. The table according to claim 17 wherein at least one of the gear wheel (94) and the drive disk is rotatably supported in a housing (91), the housing (91) is connectable with an end of an extension (60, 61) and the housing (91) further receives a worm shaft (92) and the worm wheel (94).

19. The table according to claim 16 wherein at least one of the gear wheel (94) and a drive disk is rotatably supported in a housing (91), the housing (91) is connectable with an end of an extension (60, 61) and the housing (91) further receives a worm shaft (92) and the worm wheel (94).

20. A table having a table frame (4), a tabletop (2) and a control device (11) for adjusting height and inclination of the table, the control device (11) comprising: two support devices (14, 15) pivotally attached to an upper region of a transverse middle of a support frame (6) about transversely extending frame pivot shafts (16, 17);

the support devices (14, 15) on an underside of the tabletop (2) supported on the tabletop (2) about transversely extending tabletop pivot shafts (30, 31), and the support devices (14, 15) are guided adjustably by means in a depth of the tabletop (2);

the control device (11) selectively raises at least one of the support devices (14, 15) in an upward direction toward the tabletop (2), the control device (11) selectively lowers at least one of the support devices (14, 15) in a downward direction toward the support frame (6), and the tabletop pivot shafts (30, 31) of the support devices (14, 15) are moveable relative to one another;

said means including two slides (22, 23) adjustable within guide rails (26), a common threaded spindle (27) having two opposing threaded segments (28, 29), the threaded segments (28, 29) adjustably fixed undisplaceable and freely rotatable on the underside of the tabletop (2) in correspondingly opposed threaded bores of the slides (22, 23); and two threaded segments (28, 29) of the threaded spindle (27) connected by a coupling (32), a drive mechanism connected to one of the threaded segments (28) which is oriented toward a front end of the tabletop (2), and with the coupling (32) in an engaged position, a height of the tabletop (2) being fixed, and with the coupling (32) in a disengaged position, the height and an inclination of the table top (2) being variable by the drive mechanism.

21. The table according to claim 20 wherein the support devices (14, 15) are each guided by a respective extension (60, 61) into two supports (10) of the support frame (6); and a free end of each of the support devices (14, 15) has a rotatably supported gear wheel (94), the rotatably supported gear wheel (94) self-lockingly meshes with a circular-shaped rack (95) the gear wheel (94) and the rack (95) are aligned with the extending pivot shafts (16, 17) of the support devices (14, 15), and the gear wheel (94) and the rack (95) are secured to the supports (10) of the support frame (6).

22. A table having a table frame (4), a tabletop (2) and a control device (11) for adjusting height and inclination of the table, the control device (11) comprising: two support devices (14, 15) pivotally attached to an upper region of a transverse middle of a support frame (6) about transversely extending frame pivot shafts (16, 17);

the support devices (14, 15) on an undesirable of the tabletop (2) supported on the tabletop (2) about transversely extending tabletop pivot shafts (30, 31), and the support devices (14, 15) are guided adjustably by means in a depth of the tabletop (2);

the control device (11) selectively raises at least one of the support devices (14, 15) in an upward direction toward the tabletop (2), the control device (11) selectively lowers at least one of the support devices (14, 15) in a downward direction toward the support frame (6), and the tabletop pivot shafts (30, 31) of the support devices (14, 15) are moveable relative to one another;

the support devices (14, 15) are each guided by respective extensions (60, 61) into two lateral supports (10) of the support frame (6);

each of the extensions (60, 61) are coupled to catches (62, 63), the catches (62, 63) are adjustable on horizontal threaded shafts (64, 65), the horizontal threaded shafts (64, 65) are rotatably supported in the lateral supports (10);

each of the threaded shafts (64, 65) have a drive disk (66, 67) attached in a manner fixed against relative rotation;

each of the drive disks (66, 67) are connected to one of the support devices (14, 15), each of the drive disks (66, 67) rotate by endless chains (68, 69); and each of the endless chains (68, 69) moves each of the support devices (14, 15), and each of the endless chains (68, 69) is moveable while the other is at rest.

23. The table according to claim 22 wherein the threaded shafts (64, 65) are connected to the two support devices (14, 15) which have opposed thread directions; and the endless chains (68, 69) revolve in a same directions when driven together.

24. The table according to claim 23 wherein the endless chains (68, 69) are guided by a cage (80) around the drive disks (66, 67) and away from the drive disks (66, 67) the endless chains (68, 69) are guided within at least one of a hose and a tube (72, 73).

25. The table according to claim 22 wherein the endless chains (68, 69) are guided by a cage (80) around the drive disks (66, 67) and away from the drive disks (66, 67) the endless chains (68, 69) are guided within at least one of a hose and a tube (72, 73).

26. The table according to claim 25 wherein the endless chains (68, 69) are each guided through one respective drive coupling disk (74, 75) disposed on the underside of the tabletop (2);

the two drive coupling disks (74, 75) are parallel to a common axis of rotation (76); and a drive mechanism is selectively coupled to at least one of drive sockets (77, 78).

27. The table according to claim 22 wherein the endless chains (68, 69) are each guided through one respective drive coupling disk (74, 75) disposed on the underside of the tabletop (2);

the two drive coupling disks (74, 75) are parallel to a common axis of rotation (76); and a drive mechanism is selectively coupled to at least one of drive sockets (77, 78).

* * * * *